US008752913B2

(12) United States Patent
Yanni

(10) Patent No.: US 8,752,913 B2
(45) Date of Patent: Jun. 17, 2014

(54) SEALED WALL CABINET

(76) Inventor: Glenn Yanni, Pipersville, PA (US)

( * ) Notice: Subject to any disclaimer, the term of this patent is extended or adjusted under 35 U.S.C. 154(b) by 176 days.

(21) Appl. No.: 13/159,574

(22) Filed: Jun. 14, 2011

(65) Prior Publication Data

US 2012/0200211 A1 Aug. 9, 2012

Related U.S. Application Data

(60) Provisional application No. 61/440,623, filed on Feb. 8, 2011.

(51) Int. Cl.
*A47B 67/02* (2006.01)

(52) U.S. Cl.
USPC ..... 312/242; 312/296

(58) Field of Classification Search
USPC ..... 312/242, 245, 296, 326, 329; 16/239; 49/395, 401, 402
See application file for complete search history.

(56) References Cited

U.S. PATENT DOCUMENTS

| | | | | | |
|---|---|---|---|---|---|
| 1,027,397 | A | | 5/1912 | Adam | |
| 1,743,273 | A | * | 1/1930 | Hammer | 312/242 |
| 3,023,601 | A | * | 3/1962 | Luikart et al. | 70/297 |
| 3,088,627 | A | | 5/1963 | Saunders | |
| 3,175,873 | A | | 3/1965 | Blomquist et al. | |
| 3,697,723 | A | * | 10/1972 | Winsler et al. | 219/218 |
| 3,912,348 | A | * | 10/1975 | Seymour | 312/100 |
| 4,056,211 | A | * | 11/1977 | Zumwalt | 220/592.06 |
| 4,134,625 | A | * | 1/1979 | Palka | 312/206 |
| 4,667,580 | A | | 5/1987 | Wetzel | |
| 4,888,919 | A | * | 12/1989 | Strosberg et al. | 49/502 |
| 4,941,071 | A | | 7/1990 | Knauf | |
| 4,998,587 | A | * | 3/1991 | Thomas | 169/51 |
| 5,171,078 | A | * | 12/1992 | Oslin et al. | 312/325 |
| 5,355,627 | A | * | 10/1994 | Katz | 49/479.1 |
| 5,464,475 | A | | 11/1995 | Sikes et al. | |
| 5,954,411 | A | * | 9/1999 | Katz | 312/242 |
| 6,007,171 | A | | 12/1999 | Varellas-Olree | |
| 6,093,890 | A | | 7/2000 | Gretz | |
| 6,170,928 | B1 | * | 1/2001 | Eardley et al. | 312/223.1 |
| 6,286,918 | B1 | * | 9/2001 | King | 312/326 |
| 6,346,674 | B1 | * | 2/2002 | Gretz | 174/58 |
| 6,588,543 | B1 | | 7/2003 | Tchilinguirian | |
| 6,669,041 | B2 | | 12/2003 | Almond | |
| 6,733,095 | B1 | * | 5/2004 | Rieb | 312/122 |
| 6,775,593 | B1 | | 8/2004 | Parker et al. | |
| 7,173,194 | B2 | | 2/2007 | Rupert | |
| 7,257,927 | B2 | | 8/2007 | Sayer | |
| 7,595,446 | B2 | | 9/2009 | Turcovsky et al. | |
| 7,777,132 | B2 | | 8/2010 | Ozawa et al. | |
| 8,124,873 | B1 | * | 2/2012 | Gretz | 174/66 |
| 2003/0070404 | A1 | | 4/2003 | Calabrese | |

(Continued)

*Primary Examiner* — Darnell Jayne
*Assistant Examiner* — Ryan A Doyle
(74) *Attorney, Agent, or Firm* — Gregory J. Gore

(57) ABSTRACT

A sealed cabinet for clean rooms and other controlled environments includes a single unitary elastomeric gasket which surrounds a flange around the periphery of the front of the cabinet which acts to seal both the rear of the flange against the room wall and the closure door against the flange around the cabinet opening. The gasket has a tapered configuration that provides a smooth tapered peripheral edge in close conformity with the surface of the wall for easy cleaning and to avoid the accumulation of dust. Cabinet mounting means clamp against the inside surface of the wall and are actuated from the interior of the cabinet eliminating any exposed mounting hardware.

7 Claims, 2 Drawing Sheets

(56) References Cited

U.S. PATENT DOCUMENTS

| | | | | |
|---|---|---|---|---|
| 2003/0178421 | A1 | 9/2003 | Almond | |
| 2005/0104484 | A1* | 5/2005 | Landsberger et al. | 312/194 |
| 2006/0169471 | A1* | 8/2006 | Rupert | 174/50 |
| 2007/0145871 | A1* | 6/2007 | Christie | 312/329 |
| 2007/0159037 | A1* | 7/2007 | Hoffman | 312/322 |
| 2007/0169955 | A1 | 7/2007 | Pape et al. | |
| 2007/0194180 | A1* | 8/2007 | Korcz | 248/56 |
| 2009/0015121 | A1* | 1/2009 | Sampson | 312/242 |

* cited by examiner 3
25
21
17
18
25
16
13
15
9
3
21
18
19
16
13
17
12
18
10
20
19
11

FIG.2
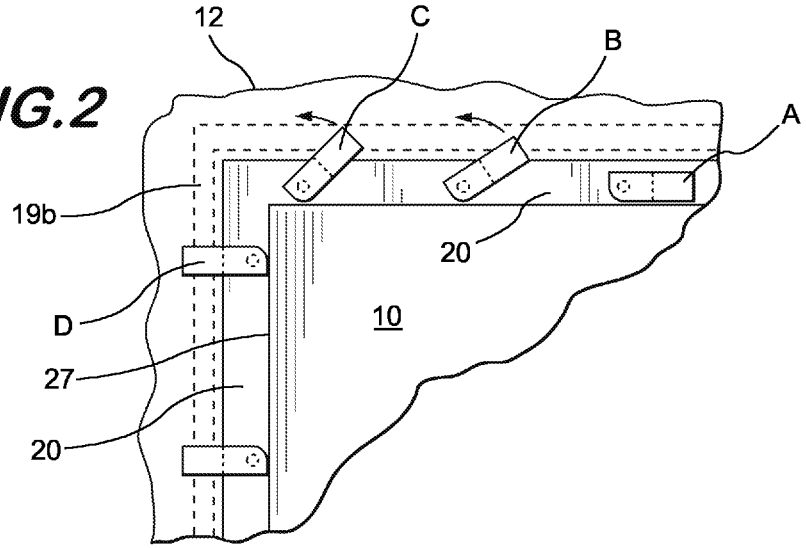
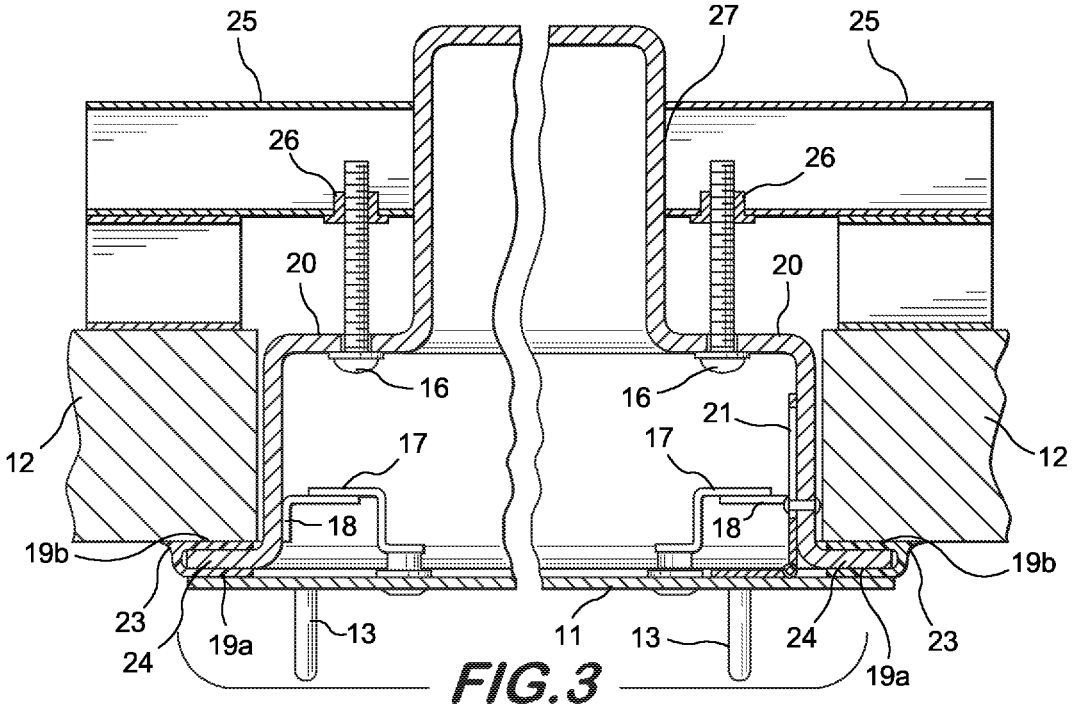
FIG.3

SEALED WALL CABINET

RELATED APPLICATION

This patent application is related to provisional patent application Ser. No. 61/440,623 entitled "Wall Mounted Sealed Enclosure" filed on Feb. 8, 2011, priority from which is hereby claimed.

FIELD OF THE INVENTION

The present invention relates to a sealed cabinet that is mounted into a wall. More specifically, it pertains to a double sealing gasket construction which enables a single gasket to seal both the cabinet closure door and the body of the cabinet to a wall.

BACKGROUND OF THE INVENTION

Certain special environments in which personnel work require either a controlled atmosphere and/or a "clean room" ultra-sanitary environment. This requires that all objects within the room be easily cleaned and that any enclosed spaces be effectively sealed against their surrounding environment. Furthermore, the entire room which defines the ultra-sanitary environment must itself be sealed to prevent the ingress of contaminants. To seal the entire room, all wall surfaces must be sealed against any holes, cracks or gaps. It is a known practice in clean rooms to mount various devices in wall-mounted enclosures so that those appliances or articles do not stand on the floor and any associated wiring and electrical connections need not be separately cleaned.

The closest prior art to which the invention pertains includes U.S. Pat. No. 6,588,543 issued to Tchilinguirian. This patent discloses a mounting bracket having a plurality of spring-loaded dog assemblies for clamping a retaining bezel to a ceiling or wall of a building structure. U.S. Pat. No. 6,170,928 issued to Eardley et al. discloses a multi-latch door for an electrical cabinet which includes a gasketed section to provide an area of the cabinet with an airtight seal for protecting components inside the cabinet. U.S. Pat. No. 6,669,041 issued to Almond discloses a service box for mounting in a floor a rigid container having walls and a lid for covering an upper opening in the container.

Despite attempts in the art to provide a sealed, wall-mounted enclosure in the room of a building having a specially controlled environment, no prior art provides an efficient and effective method of constructing a cabinet that features no un-cleanable gaps or surfaces, with a sealing means which provides both an airtight seal between the outside of the cabinet and the wall, while also sealing the cabinet access door.

SUMMARY OF THE INVENTION

In order to meet the needs in the art, the Applicant has devised the present sealed cabinet for clean rooms which require extreme cleanliness, ease of cleaning and the maintenance of a controlled atmosphere in the room. According to a unique structural configuration which will be more fully described herein, a single unitary elastomeric gasket surrounds a flange around the periphery of the front of the cabinet which acts to seal both the rear of the flange against the wall and the closure door against the flange around the cabinet opening. Furthermore, this sealing gasket has a tapered configuration such that it provides a smooth tapered peripheral edge in close conformity with the surface of the wall along its peripheral edge for easy cleaning and to avoid the accumulation of dust. Adding to the cleanability of its outside surface, the cabinet of the present invention has mounting means which are internal to the wall and actuated only from the interior of the cabinet, thus eliminating any exposed mounting hardware. The cabinet of the present invention can be of any suitable dimension to house whatever articles or components desired. When electrical devices are housed, the interior of the cabinet can feature provisions for any associated electrical wiring which can enter the back, bottom, top or sides of the cabinet from within the wall, having no contact with or exposure to the environment outside the front of the cabinet.

More specifically, the Applicant has invented a sealed, wall-mounted cabinet which is mounted near-flush with a front surface of the wall. The cabinet body comprises a top, a bottom, sides, a back and a front. A closure door is adapted to close off the cabinet front when in its closed position. An outwardly extending flange is located along the periphery of the cabinet front and lies parallel to the door when in the closed position. A U-shaped gasket having opposing front and rear portions surrounds a front, a back and side edges of the flange. The closure door may have spring-assisted hinges and/or handles to aid in opening and closing the door. When the door is closed and forcibly held to the cabinet by a series of latches, it is forced against the front portion of the gasket, creating an airtight seal of the interior space of the cabinet. The cabinet further includes a plurality of mounting clamps for securing the cabinet within an opening in a wall. As such, the rear portion of the gasket is tightly held between the back of the flange and a front surface of the wall by the clamps, thus providing an airtight seal between the body of the cabinet and the front surface of the wall.

At least a portion of the top, sides and bottom of the cabinet body is stepped inwardly by an inwardly extending peripheral framework located at a distance from the flange equal to or less than the depth of the wall. The clamp means extend through the peripheral framework and apply a clamp force against the back surface of the wall for forcibly urging the flange and the rear portion of the gasket against the front surface of the wall. The clamps are preferably screw-actuated compression clamps having rotatable clamp arms. The clamps begin their clamping motion when rotation of the arms is stopped by their abutment with an outer wall of the enclosure. In an alternate embodiment, the gasket may further include an outer rim tapered to a point defining a sharp outer edge which lies tight against the wall when the clamps are fully engaged. The gasket is preferably composed of molded or extruded elastomeric material suitable for the ultra-sanitary, controlled environment. The closure door may be hinged and slide hinges are employed to provide the door with a compound motion of horizontal translation and rotation about the hinge axis so that it opens easily and so that an even clamp pressure can be applied to the front portion of the gasket by the door when it is secured in its closed position by the latches.

The term "wall" may be a wall of any enclosure and is not intended to be limited to a wall of a room or a building. The various installations where the present invention may be applicable include the following: pharmaceutical production suites and manufacturing rooms, pharmaceutical packaging areas, chemical plants, flavor and fragrance manufacturing facilities, research laboratories, semiconductor manufacturing facilities, clean rooms, hospitals, operating rooms, medicenter treatment rooms, industrial shelters, process machinery and equipment control enclosures, packaging equipment control and monitoring equipment, medical device fabrication or cleaning equipment or facility, surgical supply cleaning or packaging equipment facilities, food and beverage process facilities. Furthermore, the present cabinet may be used as an enclosure for: control equipment, monitoring equipment, safety equipment, building/room environmental control equipment, lighting control equipment, power distribution panels, water & sewer control panels, storage cabinets, computer equipment, operator stations, enclosure installation in a much larger cabinet, hinged or fixed window or room pass-throughs.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 2 is a rear elevation view showing the clamping means at different degrees of actuation.

FIG. 3 is a top plan sectional view taken from FIG. 1 as shown in that Figure with the closure door in its closed position.

DESCRIPTION OF THE PREFERRED EMBODIMENT

Figure 1:
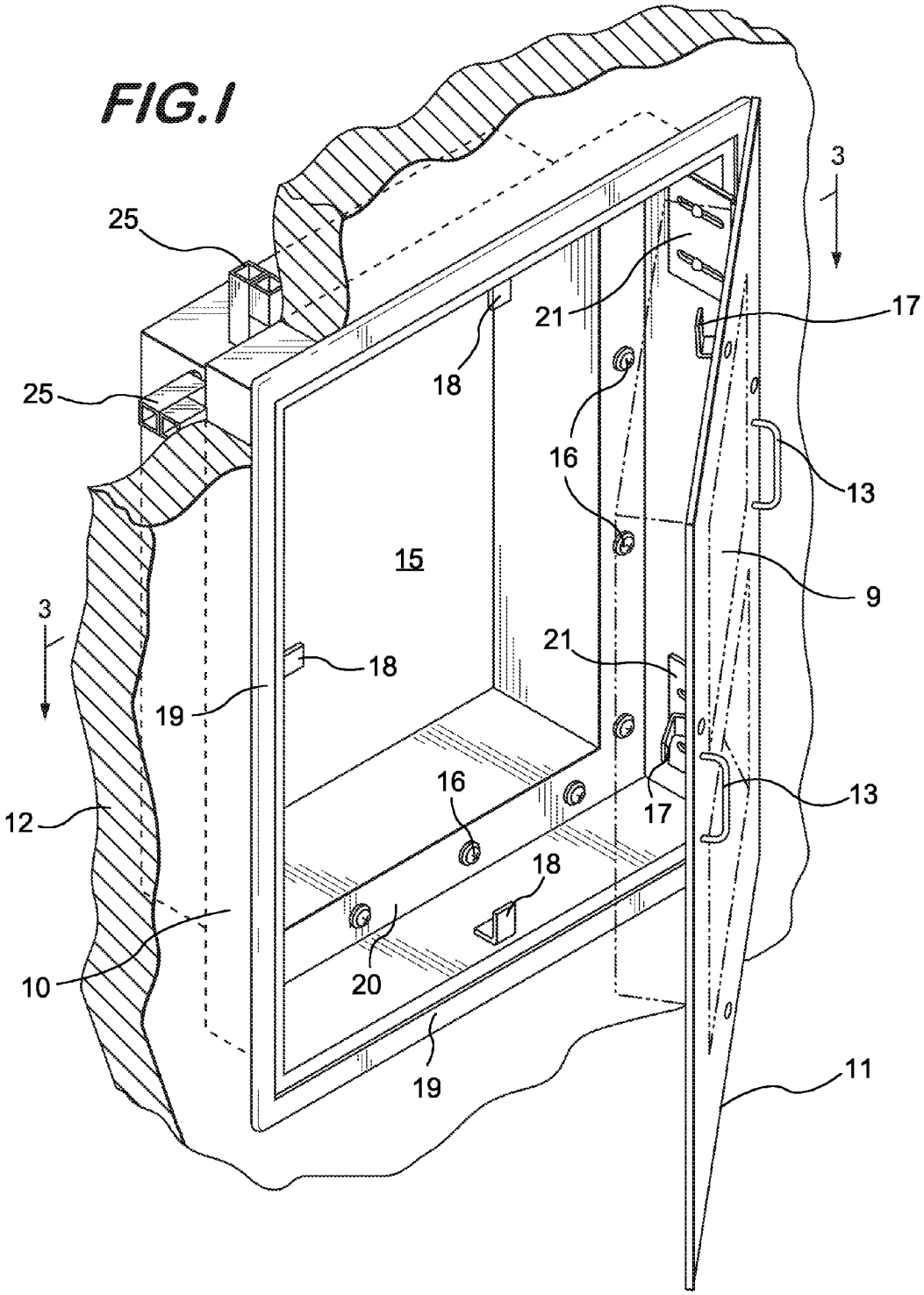
FIG. 1 is a top left front isometric view of the cabinet of the invention installed in a wall.

Referring now to FIG. 1, the cabinet 10 of the present invention is depicted installed in wall 12. One purpose of the cabinet is to house various types of appliances that may be used by personnel when the appliances need to be isolated from the surrounding environment. The body of the cabinet lies behind the front surface of the wall so that when the door 11 is closed, it lies near flush with the front surface of the wall and it can be forcibly secured by cooperating latch means 17 and 18. The front opening of the cabinet is configured to eliminate any gap between the closure door perimeter and the front opening when the door is in the closed position. Handles 13 or spring actuated hinges (not shown) assist in the translational movement of the door between open and closed positions. The body of the cabinet is stepped inwardly on all four sides by an inwardly extending framework 20. The framework is located at a distance from the front of the cabinet approximately equal to or greater than the depth of wall 12 to provide clearance for operation of clamps 25 which as further described herein are operated by turning headed screws 16 that extend through the framework 20. The clamps in this embodiment are fabricated from two pieces of welded, square-cross-section tubing which are configured to provide a generally L-shaped clamp with the major portion being an arm of the clamp hereinafter referred to as a "clamp arm". Gasket 19 surrounds a flange, as seen in FIG. 3 as feature 24, which extends outwardly from the front opening of the cabinet. The gasket seals the door to the cabinet and the cabinet to the wall. Slide hinges 21 provide a compound motion of the door as it moves between its open and closed positions. The slide hinges provide a preliminary translational motion of the pivot axis away from the cabinet so that the edge of the door adjacent to the hinges will clear the gasket when the door is thereafter swung open. As exemplary of a device which may be enclosed in the cabinet, a computer device 9 is shown mounted to the back of the door 11. Devices such as computer monitors and terminals which may be housed in the cabinet may also have associated communications and electrical wiring (not shown) that may enter the back, sides, top or bottom of the cabinet from inside the wall. A panel 15 which constitutes the back wall of the cabinet may be omitted as in the case where the cabinet is used as a pass-through.

Referring now to FIGS. 2 and 3, greater detail of the clamping and latching mechanisms is shown from a rear view of cabinet 10. The clamps are preferably screw-actuated compression clamps which first rotate from a stowed position to a clamping position and then move forwardly against the back surface of the wall 12 as the screw is turned. In the stowed position, the arms of the clamps 25 lie against the sides of the cabinet behind the framework 20 so that they will clear the sides of the wall opening when the cabinet is first introduced into the wall. As the screws are turned, the rotary motion of the clamps is stopped by abutment between a toe portion of the clamp arms and the side 27 of the cabinet which stops its rotation at a point where the arms extend radially outwardly from the side of the cabinet. Clamps A, B, C and D show sequential movement of the clamp arms as they turn with the screw. Clamp A indicates the stowed position of a clamp which lies below the flange and behind framework 20 to clear the edges of the wall aperture into which the cabinet is installed. Intermediately positioned clamps B and C show movement of these clamp arms toward their position of full rotation in which clamp D is placed when translational clamping action can begin. When the screws are turned further, the clamp arms are then pulled forwardly against the back surface of the wall thus clamping the cabinet securely to the wall against the rear portion 19*b* of the gasket covering the flange.

As shown in FIG. 3, this compound motion is provided by torque nuts 26 affixed to the clamp arms which frictionally engage the screws 16 at rest. This stationary friction with the nut is first overcome before the screw rotates relative to the clamp arms and move them translationally. As described above, this forward movement of the clamp arms does not occur until the arms rotate with the screw to their moment of contact with the side of the cabinet. It will be understood by these relations that a structurally more rigid mechanism is achieved by the continuous contact between the clamp arm and the side of the cabinet which forcibly counteracts the opposing tipping force acting against the screw caused by the clamping force.

Referring again to FIG. 3, the cabinet of the present invention is shown fully installed in wall 12 and the closure door is secured by latch means 17/18. Gasket 19 provides a double sealing of the door-to-cabinet and cabinet-to-wall interfaces; the front portion of the gasket 19*a* seals the door against the cabinet flange 24 while a rear portion of the gasket 19*b* seals the back of the flange 24 against the front surface of the wall 12. The gasket may also include a tapered edge 23 which converges to a sharp point that lies closely along the front surface of the wall when the enclosure is clamped into place thus providing a smooth, easily cleanable joint between the outside surface of the gasket and wall surface. The clamp arms are L-shaped so that walls of various thicknesses can be accommodated.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is

1. A sealed in-wall cabinet, comprising:

a cabinet body having a top, a bottom, sides and a front opening with a closure door adapted to close off said cabinet front opening when in a closed position;

an outwardly extending flange located along the periphery of said cabinet front opening;

a U-shaped gasket having opposing front and rear portions surrounding a front, a back and side edges of said flange;

said closure door having means for moving said door between open and closed positions wherein said door is forcibly pressed against the front portion of said gasket when said door is in the closed position providing an airtight seal of an interior space of said cabinet;

a plurality of latches affixed to said closure door for forcibly holding said closure door against said gasket and said flange;

wherein said latches pass through the front surface of said closure door and engage an inside surface of said cabinet;

mounting means for attaching the cabinet into a wall having an opening into which said cabinet is installed;

wherein a rear portion of the gasket is tightly held between the back of said flange and a front surface of said wall providing an airtight seal there between; and wherein at least a portion of said top, sides and bottom of said body is stepped inwardly by a peripheral framework located rearward of said wall at a distance from said flange equal to or less than the depth of said wall.

2. The cabinet of claim 1 wherein said mounting means comprises clamp means operable from the interior of said cabinet and extending through said peripheral framework, said clamp means contacting a back surface of the wall for forcibly urging said flange and the rear portion of said gasket against the front surface of said wall.

3. The cabinet of claim 2 wherein said clamp means comprises a screw threadably engaging compression clamps having rotatable clamp arms.

4. The cabinet of claim 3 wherein said clamp means begin their translational clamping motion only after rotation of said arms is stopped by their abutment with an outer surface of said cabinet.

5. The cabinet of claim 4 wherein said wall is a wall of a room in a building.

6. The cabinet of claim 5 wherein said gasket further includes an outer edge tapered to a point defining a sharp outer edge thereof, said outer edge lying against said wall when said clamp means are fully engaged.

7. The cabinet of claim 5 wherein said gasket is unitary and composed of a molded or extruded elastomeric material.

* * * * *